US007945187B2

(12) United States Patent
Terae et al.

(10) Patent No.: US 7,945,187 B2
(45) Date of Patent: May 17, 2011

(54) IMAGE FORMING APPARATUS

(75) Inventors: Takuya Terae, Abiko (JP); Akinori Tanaka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 12/023,529

(22) Filed: Jan. 31, 2008

(65) Prior Publication Data

US 2008/0193159 A1 Aug. 14, 2008

(30) Foreign Application Priority Data

Feb. 13, 2007 (JP) ..... 2007-031882

(51) Int. Cl.

| | |
|---|---|
| ***G03G 21/00*** | (2006.01) |
| ***G03G 15/08*** | (2006.01) |
| ***G03G 15/01*** | (2006.01) |
| ***G03G 15/095*** | (2006.01) |

(52) U.S. Cl. ..... 399/98; 399/102; 399/227; 399/264; 399/358; 399/360

(58) Field of Classification Search ..... 399/98, 399/102–106, 227, 247, 257, 264, 358, 359, 399/360

See application file for complete search history.

(56) References Cited

U.S. PATENT DOCUMENTS

| | | | | |
|---|---|---|---|---|
| 4,707,108 | A * | 11/1987 | Akio | 399/227 |
| 4,943,829 | A * | 7/1990 | Sasaki et al. | 399/105 |
| 5,075,735 | A * | 12/1991 | Tsuchiya et al. | 399/225 |
| 5,245,357 | A * | 9/1993 | Maruyama et al. | 346/134 |
| 6,201,939 | B1 * | 3/2001 | Yamamoto et al. | 399/99 |
| 7,447,463 | B2 * | 11/2008 | Koido | 399/103 |

FOREIGN PATENT DOCUMENTS

JP 11-84793 A 3/1999

* cited by examiner

*Primary Examiner* — David M Gray
*Assistant Examiner* — Francis Gray
(74) *Attorney, Agent, or Firm* — Fitzpatrick, Cella, Harper & Scinto

(57) ABSTRACT

An image forming apparatus includes: an image bearing member, on which an electrostatic image is formed; a development unit which is provided with a developer bearing member for bearing and conveying a developer, so as to develop the electrostatic image; a storage place which can store therein the developer spattering from the development unit; a shielding member which is disposed in a region outside of a development region in the storage place; and a foreign material collecting member which is disposed in a region farther outside of the shielding member in the storage place.

5 Claims, 7 Drawing Sheets

IMAGE FORMING APPARATUS

BACKGROUND OF THE INVENTION

1. Field of the Invention

The present invention relates to an image forming apparatus such as a copying machine, a printer, a recorded image display apparatus or a facsimile which forms a visible image by an electrophotographic system.

2. Description of the Related Art

In a composite machine having copying and printing functions or a facsimile, there is widely used at present time an image forming apparatus of an electrophotographic system, in which a development unit develops a toner image on an image bearing member.

In such an image forming apparatus of an electrophotographic system, it is necessary to prevent the inside the image forming apparatus from being smeared with a toner spattering from the development unit while effectively utilizing space inside the image forming apparatus in order to cope with miniaturization of the image forming apparatus.

There has been known a technique for preventing the inside the image forming apparatus from being smeared with the toner spattering from the development unit, as disclosed in Japanese Patent Application Laid-open No. 11-084793.

In an image forming apparatus disclosed in Japanese Patent Application Laid-open No. 11-084793, a developer storing tray is housed in a space on a side opposite to an image bearing member in the development unit, and further, at a lower portion in a space above a fixing device. The toner spattering from the development unit is stored in the developer storing tray, thereby preventing the inside the image forming apparatus from being smeared with the toner.

However, the technique disclosed in Japanese Patent Application Laid-open No. 11-084793 allows the toner spattering from the development unit to be stored in the developer storing tray, but also permits foreign material other than the toner, such as spattering from members other than the development unit to be stored in the developer storing tray. Members other than the development unit such as a gear train, a development bias contact, an oscillation spring and an adjusting member mostly generate foreign material (e.g., metallic powder). The foreign material, in particular, the metallic powder generated from the afore-mentioned members are deposited on the developer storing tray, and then, the deposited foreign material are carried to the development unit, thereby raising a possibility of a damage exerted on a development sleeve inside the development unit or the image bearing member disposed opposite to the development sleeve.

SUMMARY OF THE INVENTION

In view of the above-described problems, the present invention aims at preventing foreign material, which are accidentally stored at the same time in a storage place for storing therein a toner spattering from a development unit, from being carried to the development unit, and then, from causing damage to a member inside the development unit or an image bearing member disposed opposite to the member.

Accordingly, an image forming apparatus includes: an image bearing member, on which an electrostatic image is formed; a development unit which is provided with a developer bearing member rotatably disposed at a position opposite to the image bearing member, to bear and convey a developer, so as to develop the electrostatic image; a storage place which is located under the development unit and can store therein the developer spattering from the development unit; a shielding member which is disposed in a region outside of a development region of the developer bearing member in a direction of a rotary axis of the developer bearing member in the storage place; and a foreign material collecting member which is disposed in a region farther outside of the shielding member in the direction of the rotary axis of the developer bearing member in the storage place.

Further features of the present invention will become apparent from the following description of exemplary embodiments (with reference to the attached drawings).

DESCRIPTION OF THE EMBODIMENTS

A detailed description will be illustratively given below of an embodiment according to the present invention in reference to the attached drawings. Here, the dimensions, materials, size and relative arrangement of constituent parts described in the embodiment, described below, may be appropriately varied according to the configuration or various kinds of conditions of an apparatus, to which the present invention is applied. As a consequence, the scope of the present invention is not limited only to those in the disclosed embodiment, unless otherwise stated.

Figure 1:
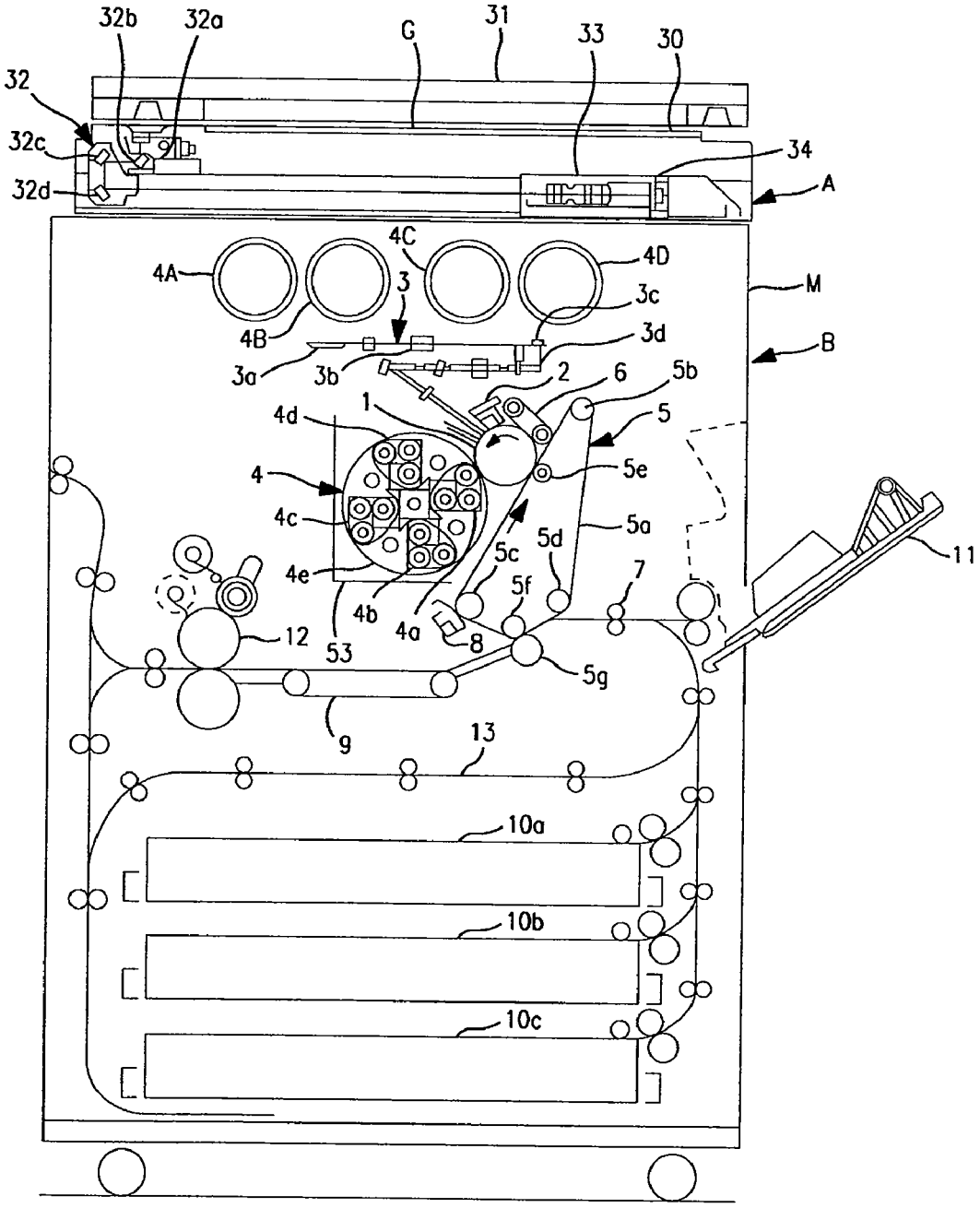
FIG. 1 is a vertical, cross-sectional view illustrating the schematic configuration of an image forming apparatus.

FIG. 1 is a vertical, cross-sectional view illustrating the schematic configuration of an image forming apparatus. The image forming apparatus shown in FIG. 1 is of a full color type. The image forming apparatus is provided, at an upper portion thereof, with a digital color image reader unit A (hereinafter simply referred to as "a reader unit A") which reads an image formed on document G. Furthermore, the image forming apparatus is provided, at a lower portion thereof; with a digital color image printer unit B (hereinafter simply referred to as "a printer unit B") which forms an image. The printer unit B includes a single photosensitive drum serving as an image bearing member, a rotary development unit serving as developing means, and an intermediate transfer belt serving as an intermediate transfer member. An explanation will be made below on each of the units A and B.

The reader unit A includes document base plate glass 30, document pressing plate 31, a scanner unit 32, a lens 33 and a CCD 34. Among these devices, the scanner unit 32 has a light source 32*a* and a plurality of mirrors 32*b*, 32*c* and 32*d*, so that the scanner unit 32 as a whole is moved toward the right in FIG. 1 from a home position shown in FIG. 1. The document G is placed on the document base plate glass 30 in such a manner that its surface having an image thereon is oriented downward. The document G is configured such that the image surface is scanned by the scanner unit 32 which is moved toward the right in FIG. 1. In other words, the scanner unit 32 emits a light beam from the light source 32*a* so as to irradiate the image surface of the document G with the light beam while being moved toward the right in FIG. 1. The resultant reflected light is further reflected on the mirrors 32*b*, 32*c* and 32*d*, and then, is input into the CCD 34 through the lens 33, to be converted into an electric signal. The electric signal is subjected to various kinds of image processing, such as shading correction, color correction and density processing in an image processing portion, not shown, to be then input into an exposing device, described later.

The printer unit B includes a drum-shaped electrophotographic photosensitive member (hereinafter referred to as "a photosensitive drum") 1 serving as an image bearing member. The photosensitive drum 1 is supported rotatably in a direction indicated by an arrow in an image forming apparatus main body (hereinafter referred to as "a main body") M. Around the photosensitive drum 1 are disposed a primary charger (i.e., charging means) 2, the exposing device (i.e., exposing means) 3, a development unit (i.e., developing means) 4, a transferring device 5 and a cleaning device 6 substantially in the named order in the rotational direction of the photosensitive drum 1. Among these constituents, the primary charger 2 is adapted to uniformly charge the surface of the photosensitive drum 1 with a predetermined polarity and at a predetermined potential. Furthermore, the exposing device 3 includes a laser emitter, not shown, a polygon mirror 3*a*, a lens 3*b*, reflection mirrors 3*c* and 3*d* and the like. An image read in the above-described reader unit A is converted into an optical signal of each of colors in the laser emitter. A laser light beam of a first color, converted into an optical signal, is reflected on the polygon mirror 3*a*, and then, exposes the charged surface of the photosensitive drum 1 through the lens 3*b*, the reflection mirrors 3*c* and 3*d* and the like. In this manner, an electrostatic image of the first color is formed on the photosensitive drum 1.

The development unit 4 includes a rotatable development rotor (i.e., a rotating member) 4*e* and four development devices (for four colors) mounted on the development rotor 4*e*, that is, a development device 4*a* for yellow (Y), a development device 4*b* for magenta (M), a development device 4*c* for cyan (C) and a development device 4*d* for black (BK). In the development unit 4, the development device for a color to be developed is located at a development position facing to the photosensitive drum 1 according to the rotation of the development rotor 4*e*, and thereafter, a toner stored in a developer adheres onto the electrostatic image formed on the photosensitive drum 1, thereby developing a toner image. Incidentally, the development unit 4 will be explained later in detail.

The transferring device 5 includes an intermediate transfer belt 5*a* serving as an intermediate transfer member stretched across a plurality of rollers. The plurality of rollers are a drive roller 5*b*, a driven roller 5*c*, a tension roller 5*d*, a primary transfer roller 5*e*, a secondary transfer counter roller 5*f* and a secondary transfer roller 5*g*. The above-described toner image formed on the photosensitive drum 1 is (primarily) transferred onto the intermediate transfer belt 5*a* by the primary transfer roller 5*e*.

The toner (i.e., a residual toner) remaining on the photosensitive drum 1 having the toner image primarily transferred thereonto is removed by the cleaning device 6, followed by image formation with a next color.

The above-described series of image forming processes including primary charging, exposure, development, primary transfer and cleaning, is repeated with respect to the other three colors. As a result, the toner images of the four colors are superimposed one on another on the intermediate transfer belt 5*a*.

These toner images of the four colors formed on the intermediate transfer belt 5*a* are (secondarily) transferred at one time onto a recording material to be conveyed between the intermediate transfer belt 5*a* and the secondary transfer roller 5*g*. The recording material is supplied from a sheet cassette 10*a*, 10*b* or 10*c* or a manual tray 11, to be conveyed to a registration roller 7 via a sheet roller, a conveying roller or the like, in which skewed feeding is corrected and the conveyance is temporarily stopped. The recording material is supplied between the intermediate transfer belt 5*a* and the secondary transfer roller 5*g* by the registration roller 7 while providing timing for the toner image formed on the intermediate transfer belt 5*a*. In this manner, the toner images of the four colors formed on the intermediate transfer belt 5*a* are transferred onto the recording material at one time. The toner (i.e., a residual toner) remaining at the surface of the intermediate transfer belt 5*a* after the toner images are transferred is removed by a belt cleaner 8, followed by next transfer of the toner image.

In the meantime, the recording material after the transfer of the toner images is conveyed to a fixing device 12 by a conveyance belt 9. In the fixing device 12, the toner image is fixed onto the recording material by heating and pressurizing, thus completing the image formation on either surface of the recording material. Here, in the case of duplex image formation, the recording material having the toner image fixed thereonto is reversed, and then, is conveyed onto a re-feed path 13, from which the recording material is fed again toward the secondary transfer roller 5*g*.

Figure 2:
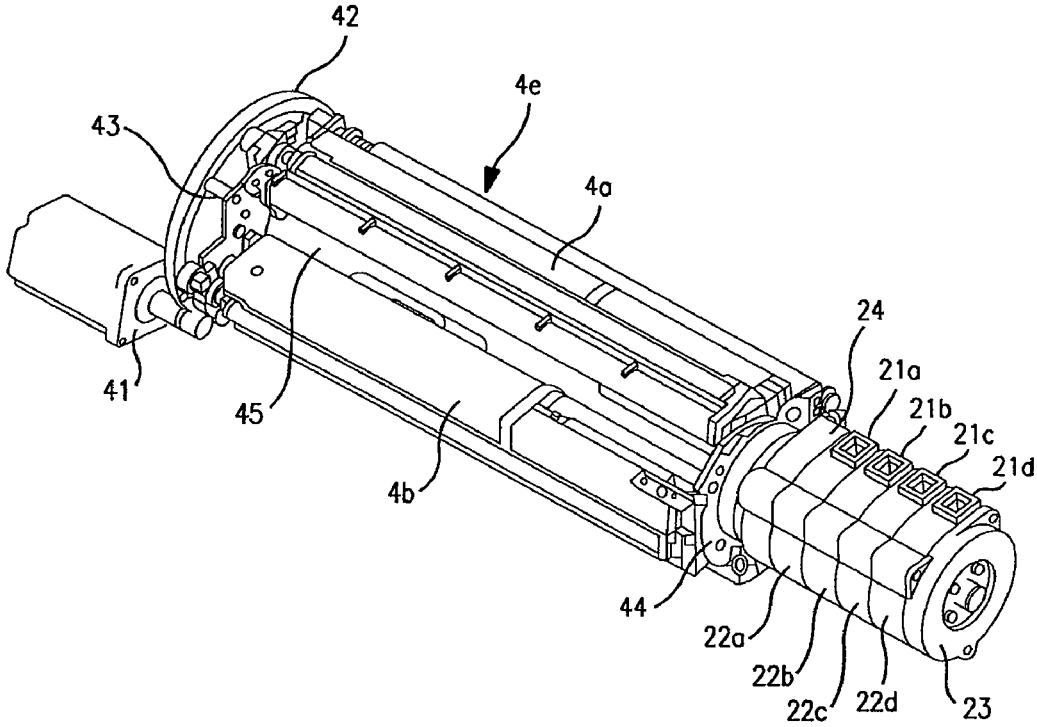
FIG. 2 is a perspective view illustrating the general configuration of a development rotor.

FIG. 2 is a perspective view illustrating the development rotor 4*e* having the above-described four development devices (only the development devices 4*a* and 4*b* are shown in FIG. 2) mounted thereon and respective toner receivers (i.e., toner replenishing ports) 21*a*, 21*b*, 21*c* and 21*d* for the development devices, as viewed from the top.

The development rotor 4*e* includes a rear plate unit 43, a fore plate unit 44 and a rotary stay (i.e., a connecting stay unit) 45 for connecting the units 43 and 44 to each other, and is supported at flanges, not shown, formed at fore and rear plates by the main body M via bearings.

A drive gear 42 integrated with the rear plate unit 43 is rotatably driven by a rotary drive motor 41 disposed in the main body M, so as to switch the development devices 4*a*, 4*b*, 4*c* and 4*d*. The rotary drive motor 41 is a stepping motor since the development devices 4*a*, 4*b*, 4*c* and 4*d* must be speedily switched at a rotational angle with reliable accuracy.

Before the development rotor 4*e* is arranged a toner receiving unit, which is provided with fixing flanges 22*a*, 22*b*, 22*c* and 22*d* having the toner receivers 21*a*, 21*b*, 21*c* and 21*d*, respectively, a flange supporting mount 24, and a flange cover 23. The toner receiving unit is fixingly housed at the fore portion in the main body M, so that the toner receivers 21*a*, 21*b*, 21*c* and 21*d* receive the toners of the colors supplied from toner cartridges (i.e., toner supplying means) 4A, 4B, 4C and 4D (see FIG. 1). Thereafter, the toner received in the toner receiving unit is delivered down to the toner conveying means inside the development rotor 4*e*.

Figure 3:
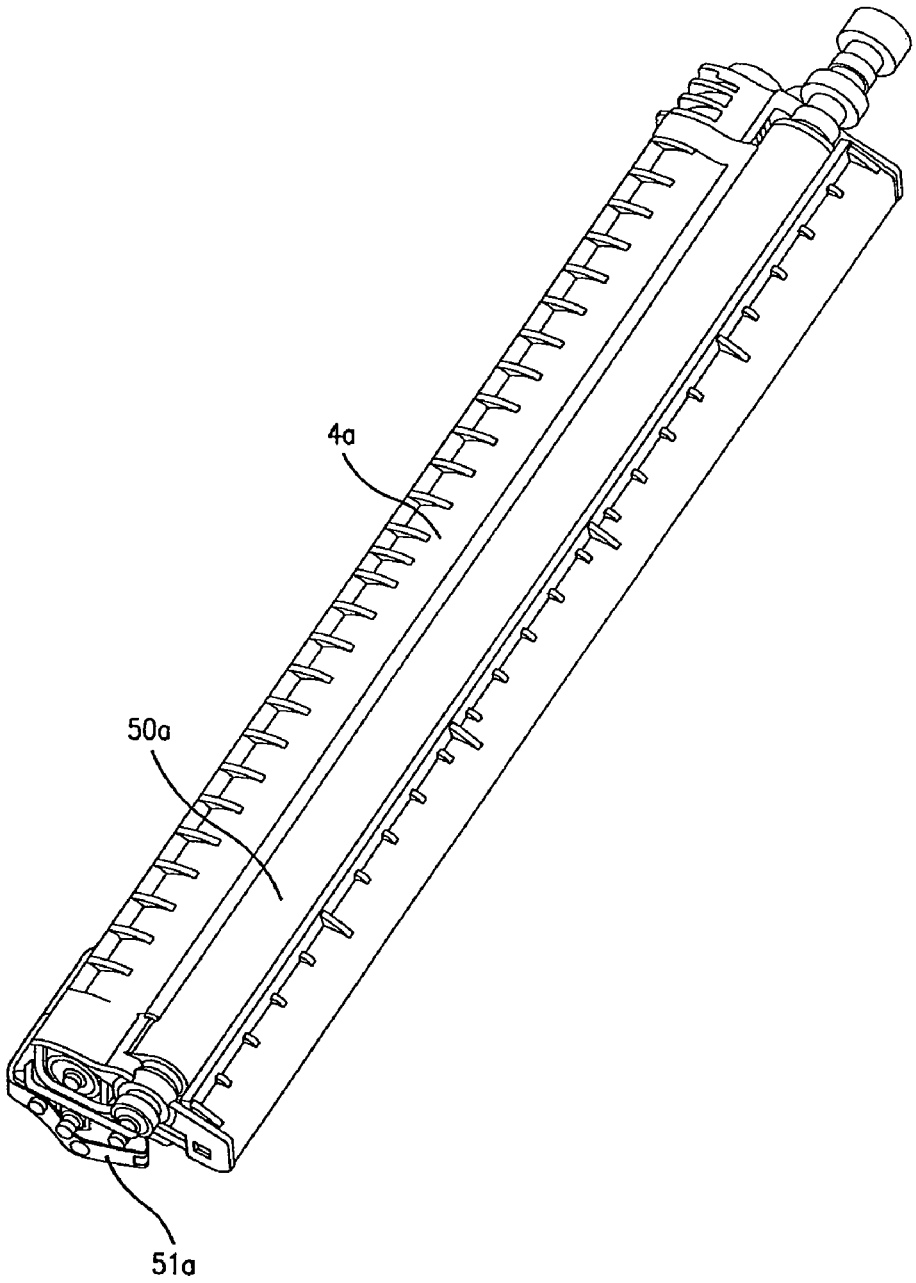
FIG. 3 is a perspective view illustrating the general configuration of a development device.
Figure 4:
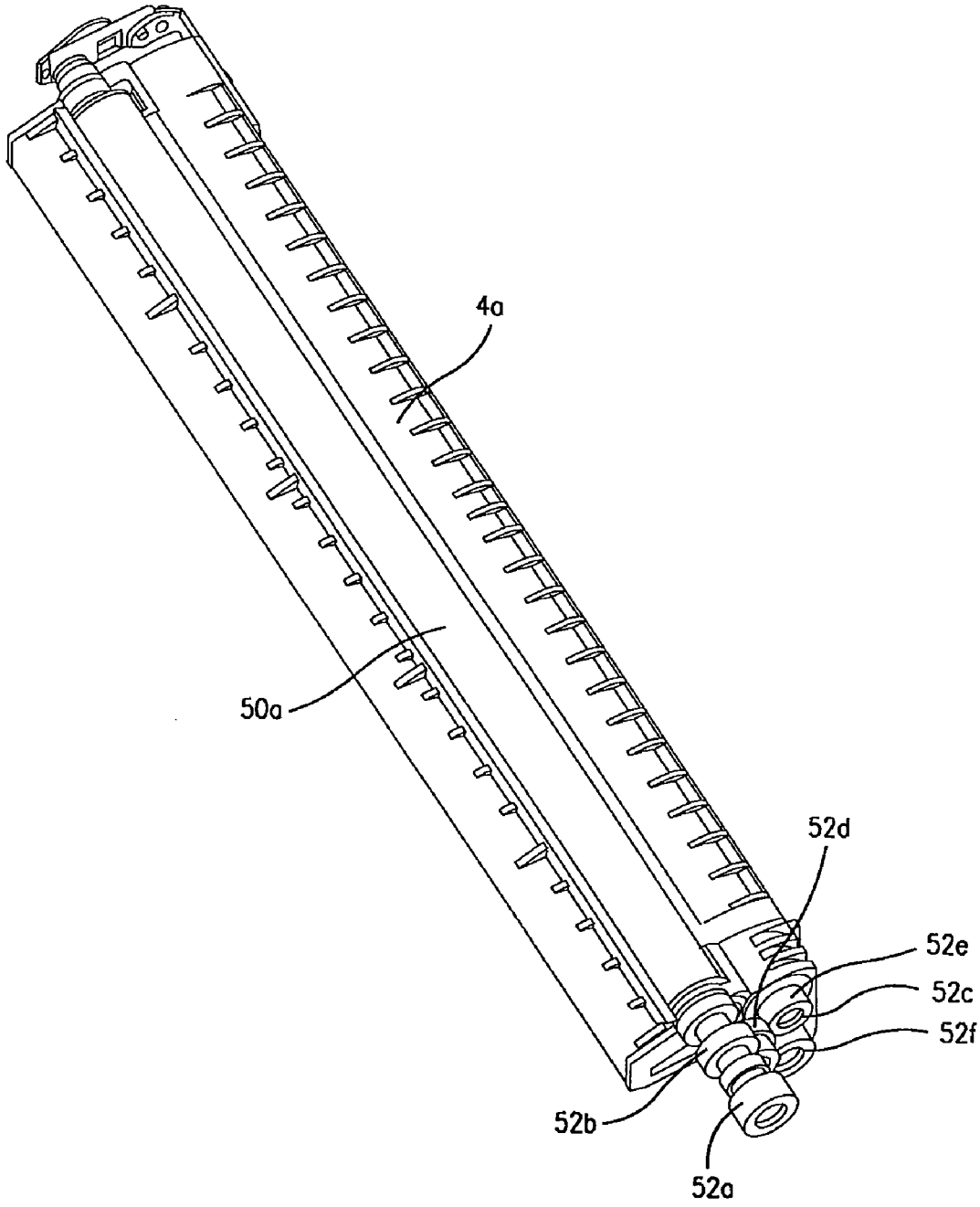
FIG. 4 is another perspective view illustrating the general configuration of the development device.

FIGS. 3 and 4 are perspective views illustrating the development device, as viewed from the bottom. FIG. 3 is a perspective view illustrating the development device, as viewed from a bias contact; and FIG. 4 is a perspective view illustrating the development device, as viewed from the drive gear. Here, since the development devices 4*a*, 4*b*, 4*c* and 4*d* have the same configuration, the development device 4*a* is typically illustrated in FIGS. 3 and 4.

The development device 4*a* includes, at a fore portion thereof, a development bias contact 51*a* serving as a high voltage contact for a development sleeve 50*a*. The development bias contact 51*a* is designed to be brought into contact with a contact of only a color to be developed, not shown, disposed at the fore plate of the development unit 4 during the development. As a consequence, the development bias contact 51*a* is brought into slidable contact with the contact, not shown, disposed at the fore plate of the development unit 4 in switching the development devices 4*a*, 4*b*, 4*c* and 4*d*, metallic powder is generated due to the abrasion of the contact.

Moreover, the development device 4*a* includes, at a rear portion thereof, a development drive gear 52*a* serving as a gear for driving the development sleeve 50*a*, and other development drive gears 52*b*, 52*c*, 52*d*, 52*e* and 52*f* serving as gears for driving a toner conveying screw, not shown. The development drive gear 52*a* is designed to rotatably drive the development drive motor for only the color to be developed, not shown, disposed in the main body M during the development. The rotational drive of the development drive gear 52*a* rotates the development drive gears 52*b*, 52*c*, 52*d*, 52*e* and 52*f*, thereby rotatably driving the toner conveying screw, not shown. Consequently, the development drive gears 52*b*, 52*c*, 52*d*, 52*e* and 52*f* are brought into slidable contact with each other during the rotational drive of the development drive gear 52*a*, thereby generating foreign material such as swarf of a resin due to the abrasion of the gears.

Figure 5:
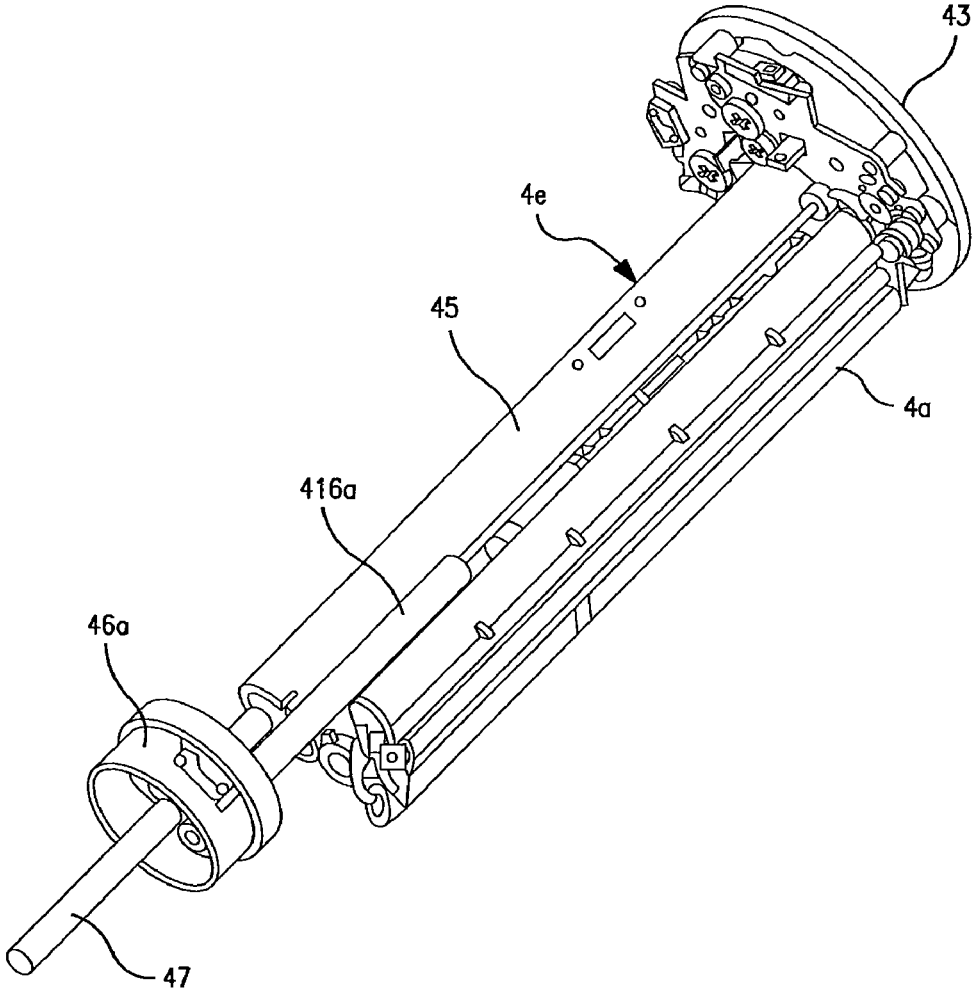
FIG. 5 is a perspective view explanatory of the particulars of a toner conveyor in the development rotor.

FIG. 5 is a perspective view partly illustrating the toner conveying means inside the development rotor 4*e*. As shown in FIG. 5, the toner conveying means includes a cylindrical rotary drum (i.e., a first cylindrical rotor) 46*a* and a toner conveyor 416*a* containing therein the toner conveying screw for conveying the toner to the development device 4*a*. In FIG. 5, the development devices 4*b*, 4*c* and 4*d*, cylindrical rotary drums 46*b*, 46*c* and 46*d* and toner conveyors 416*b*, 416*c* and 416*d* for the other colors are omitted.

The toner conveyed from the toner cartridge 4A is conveyed to the toner receiver 21*a* shown in FIG. 2, and then, is supplied down to the rotary drum 46*a* whose opening faces right above owing to the rotation of the development rotor 4*e*.

The toner conveyor 416*a* is housed inside the cylinder of the rotary drum 46*a* in order to convey the falling toner to the development device 4*a*. The rotary drum 46*a* is configured such that its opening faces right above when the development device 4*a* is located at the development position (i.e., an image formation position) owing to the rotation of the development rotor 4*e*, and thus, the toner of only the color to be developed can be supplied during the development.

The rotary stay 45 structurally serves as a rotary axis of the development rotor 4*e*. An extension axis 47 is combined coaxially with the rotary stay 45 toward the rotary drum from the rotary stay 45, to be fitted to and positioned at a center hole of the rotary drum 46*a*. In this manner, the rotary drum 46*a* is configured in such a manner as to be rotated with a reliable accuracy of a coaxial degree with respect to the rotary stay 45 of the development rotor 4*e* during the rotation of the development rotor 4*e*.

Figure 6:
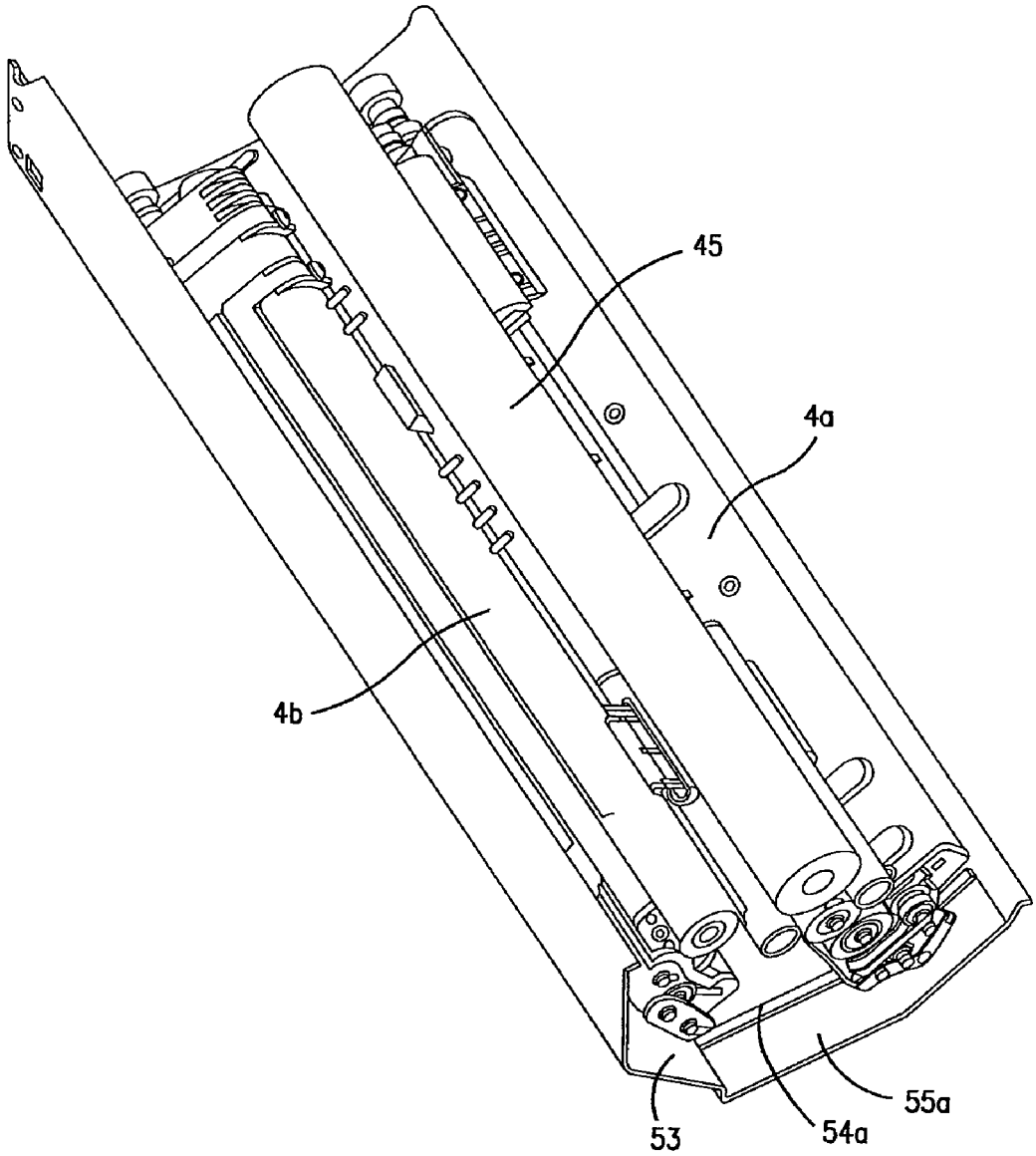
FIG. 6 is a perspective view explanatory of the particulars of a toner storage place in the development rotor.
Figure 7:
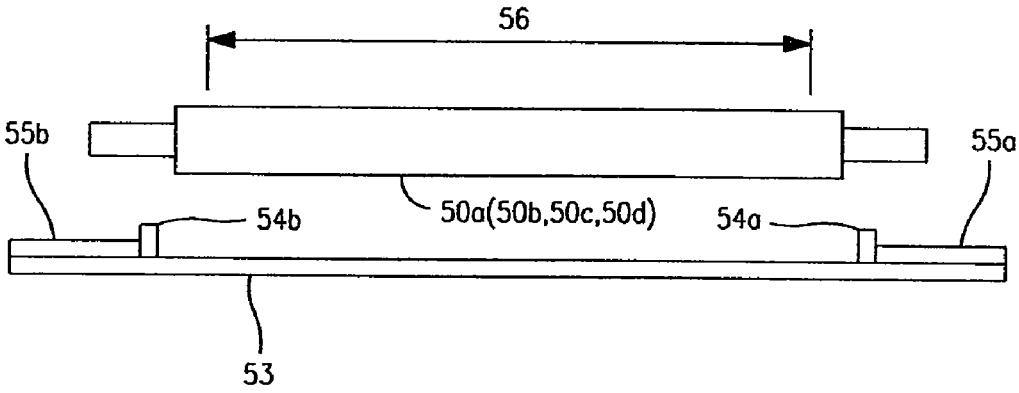
FIG. 7 is a view illustrating the toner storage place in a longitudinal direction.

FIG. 6 is a perspective view partly illustrating a toner storing member inside the development rotor 4*e*; and FIG. 7 is a view illustrating the longitudinal relationship between the toner storing member and the development sleeve in the development device. As shown in FIGS. 6 and 7, the toner storing member 53 is storing means (i.e., a storage place) for storing therein the toner spattering from a development region 56, in which the photosensitive drum and the development device (i.e., the development sleeve) face each other. The toner storing member 53 includes shielding members (i.e., shielding means) 54*a* and 54*b* for shielding the boundaries between the development region 56 and non-development regions other than the development region. The shielding members 54*a* and 54*b* are disposed on both sides of the boundaries between the development region 56 and the non-development regions. Moreover, the toner storing member 53 includes collecting members (i.e., collecting means) 55*a* and 55*b* for collecting the foreign material spattering from the outside of the development region. The collecting members 55*a* and 55*b* are disposed in both of the non-development regions shielded by the shielding members 54*a* and 54*b*, respectively. That is to say, the shielding members 54*a* and 54*b* and the collecting members 55*a* and 55*b* are disposed backward and forward of the development unit 4, respectively.

The toner storing member 53 structurally also serves as a stay for the development unit 4 and for the purpose of cost reduction owing to the reduction of the number of component parts. Therefore, the toner storing member 53 is arranged in such a manner as to cover the development rotor 4*e* in the rotational direction within a range in which the development devices 4*a*, 4*b*, 4*c* and 4*d* are switched without any interference in order to cope with the miniaturization of the image forming apparatus (see FIG. 1).

The shielding members 54*a* and 54*b* are the shielding means for shielding the development region 56, in which the photosensitive drum 1 and the development unit (i.e., the development device located at the development position) 4 face each other, from the non-development regions other than the development region 56. The shielding members 54*a* and 54*b* are mounted on the storing member 53 in such a manner as to shield the development region 56 from the non-development regions. More particularly, the shielding members 54*a* and 54*b* are disposed on both sides of the boundaries between the development region 56 and the non-development regions (i.e., backward and forward of the development unit 4), respectively. The development region signifies a region in which the development sleeve 50*a* and the photosensitive drum 1 face each other, and further, a region which is shielded by the shielding members 54*a* and 54*b* mounted on the storing member 53. The non-development region signifies a region other than the development region.

The collecting members 55*a* and 55*b* are the collecting means for collecting the foreign material spattering from the outside of the development unit 4. The collecting members 55*a* and 55*b* are disposed in the non-development regions on the storing member 53, that is, in both of the non-development regions shielded by the shielding members 54*a* and 54*b* (i.e., backward and forward of the development unit 4), respectively.

Each of the shielding members 54*a* and 54*b* is constituted of a foam material member. In contrast, each of the collecting members 55*a* and 55*b* is constituted of a viscous material member. The reason why the shielding member is constituted of the foam material member is that the shielding member functions as a more favorable wall which can collect the toner in addition to the function of a shielding wall if foreign material intrude into or clog a foamable unit. The reason why the collecting member is constituted of the viscous material member is that a collecting function can be efficiently achieved in a small space (i.e., in thinness) and at a reduced cost.

Additionally, the shielding members 54*a* and 54*b* and the collecting members 55*a* and 55*b* are constituted of the same member. The reason why the same member is used is that the same member is more favorably used from the viewpoint of a fabrication cost and the like since the above-described members are disposed backward and forward of the development unit 4 simply for the same purpose with the same function.

In the above-described embodiment, the toner spattering from the development region 56 is stored in the development region 56 shielded by the shielding members 54*a* and 54*b* in the storing member 53. As a consequence, the inside the image forming apparatus can be prevented from being smeared with the toner spattering from the development region 56. Furthermore, the foreign material, such as the metallic powder or the swarf of the resin spattering from other than the development region, can be shielded by the shielding members 54*a* and 54*b* from intruding into the development region 56. Moreover, the foreign material can be collected by the collecting members 55*a* and 55*b* disposed in the non-development regions shielded by the shielding members 54*a* and 54*b* in the storing member 53. Consequently, the foreign material spattering from other than the development region can be prevented from being carried to the development unit, and further, from exerting a damage on the member (i.e., the development sleeve) inside the development unit or the photosensitive drum facing the member.

Although the image forming apparatus is exemplified by the copying machine in the above-described embodiment, the present invention is not limited to this. For example, the present invention may be applied to other image forming apparatuses such as a printer, a facsimile and a composite machine having the combination of the functions of the printer and the facsimile. The same effects can be produced by applying the present invention to the above-described image forming apparatuses.

Otherwise, although the image forming apparatus includes the four development devices in the above-described embodiment, the number of development devices is not limited to four. The number of development devices can be appropriately set, as necessary. The present invention is effective irrespective of the number of development devices. Alternatively, although the plurality of development devices can be rotatably switched in the image forming apparatus, the present invention is not limited to this.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-31882, filed Feb. 13, 2007, which is hereby incorporated by reference herein in its entirety.

What is claimed is:

1. An image forming apparatus comprising:

an image bearing member, on which an electrostatic image is formed; and a development unit which develops a latent image formed on the image bearing member, comprising:

a developer bearing member which is disposed at a position opposite to the image bearing member, to bear and convey a developer and a container which (i) rotatably supports the developer bearing member and (ii) supplies the developer to the developer bearing member;

a developer receiving portion which is disposed under the development unit so as to receive developer spat from the development unit; and a wall portion which is disposed on the developer receiving portion and divides the developer receiving portion into a first area corresponding to a developer bearing area of the developer bearing member and a second area outside the first area in an axial direction of the image bearing member.

2. An image forming apparatus according to claim 1, further comprising a foreign material collecting member, which is provided for collecting foreign material on the developer receiving portion and formed on the second area of the developer receiving portion in the rotational axis direction of the developer bearing member.

3. An image forming apparatus according to claim 2, wherein the wall portion and the foreign material collecting member are formed as one body.

4. An image forming apparatus according to claim 2, wherein the wall portion is constituted as a foam material member and, the foreign material collecting member is constituted as a viscous material member.

5. An image forming apparatus according to claim 1, wherein the development unit includes a plurality of development devices, each having the developer bearing member, and a rotor which holds each development device therein so as to rotatably move the development device.

* * * * *